US009700144B2

(12) United States Patent
Arceci et al.

(10) Patent No.: US 9,700,144 B2
(45) Date of Patent: Jul. 11, 2017

(54) STUFFED CHAIR WITH ONE OR MORE SEATS, IN PARTICULAR ARMCHAIR OR COUCH

(71) Applicant: CIAR S.p.A., Pesaro (IT)

(72) Inventors: Zeno Arceci, Pesaro (IT); Egidio Marcantoni, Pesaro (IT)

( * ) Notice: Subject to any disclaimer, the term of this patent is extended or adjusted under 35 U.S.C. 154(b) by 0 days.

(21) Appl. No.: 14/640,057

(22) Filed: Mar. 6, 2015

(65) Prior Publication Data

US 2015/0250320 A1 Sep. 10, 2015

(30) Foreign Application Priority Data

Mar. 7, 2014 (IT) ..... BO2014A0118

(51) Int. Cl.

| | |
|---|---|
| ***A47C 31/00*** | (2006.01) |
| ***A47C 1/024*** | (2006.01) |
| ***A47C 7/50*** | (2006.01) |
| ***A47C 1/022*** | (2006.01) |
| ***A47C 7/38*** | (2006.01) |
| ***A47C 17/04*** | (2006.01) |

(52) U.S. Cl.

CPC ..... *A47C 7/506* (2013.01); *A47C 1/022* (2013.01); *A47C 1/0242* (2013.01); *A47C 7/38* (2013.01); *A47C 17/04* (2013.01); *A47C 31/00* (2013.01)

(58) Field of Classification Search

CPC ..... A47C 31/00; A47C 1/0242

USPC ..... 320/107, 114, 115

See application file for complete search history.

(56) References Cited

U.S. PATENT DOCUMENTS

| | | | | |
|---|---|---|---|---|
| 3,823,367 | A * | 7/1974 | Kaye | G01R 31/362 320/114 |
| 5,106,159 | A * | 4/1992 | Iwamoto | B60N 2/143 297/188.14 |
| 5,211,172 | A * | 5/1993 | McGuane | A47C 1/14 297/217.3 |
| 5,220,520 | A * | 6/1993 | Kessoku | G06F 1/1626 361/679.31 |
| 5,464,381 | A * | 11/1995 | Wilson | A47D 9/02 297/184.13 |
| 5,868,687 | A * | 2/1999 | Tedesco | A61H 1/00 297/188.01 |
| 5,975,630 | A | 11/1999 | Schreiber | |
| 6,814,709 | B2 * | 11/2004 | Schwartz | A47C 7/725 5/633 |

(Continued)

FOREIGN PATENT DOCUMENTS

| | | |
|---|---|---|
| DE | 102008018654 | 10/2009 |
| DE | 102010002833 | 9/2011 |
| EP | 1989965 | 11/2008 |

OTHER PUBLICATIONS

Italian Search Report for Italian Patent Application No. IT BO20140118 dated Jul. 29, 2014.

*Primary Examiner* — Timothy J Brindley

(74) *Attorney, Agent, or Firm* — McCarter & English, LLP

(57) ABSTRACT

A stuffed chair with one or more seats, in particular an armchair or a couch, has a seat, a backrest, and at least one mobile part, which is configured to move relative to a fixed part due to the action of an actuating device supplied with power by a rechargeable battery housed inside a containing box; the containing box being mounted in the stuffed chair and opening up outwards in correspondence to an outer surface of the stuffed chair to allow access to the rechargeable battery.

11 Claims, 3 Drawing Sheets

(56) References Cited

U.S. PATENT DOCUMENTS

| | | | | |
|---|---|---|---|---|
| 7,988,512 | B2 * | 8/2011 | Lin | B63B 35/73 441/129 |
| 8,113,517 | B2 * | 2/2012 | Canterbury | G07F 17/32 273/138.1 |
| 2012/0313407 | A1 * | 12/2012 | Calfee | B62M 25/08 297/195.1 |
| 2013/0113249 | A1 * | 5/2013 | Cvek | A47C 31/00 297/217.2 |
| 2014/0004737 | A1 * | 1/2014 | Tsai | H01M 2/10 439/500 |
| 2014/0045367 | A1 * | 2/2014 | Christie | H01M 2/1022 439/500 |
| 2014/0354019 | A1 * | 12/2014 | Massaud | A47C 7/725 297/188.01 |
| 2015/0239321 | A1 * | 8/2015 | Muller | B60H 1/00792 297/180.1 |
| 2015/0288210 | A1 * | 10/2015 | Kim | H02J 7/0052 320/107 |
| 2016/0016602 | A1 * | 1/2016 | D'Anastasi | B62B 9/22 297/260.2 |

* cited by examiner

STUFFED CHAIR WITH ONE OR MORE SEATS, IN PARTICULAR ARMCHAIR OR COUCH

The present invention relates to a stuffed chair with one or more seats, in particular an armchair or a couch.

BACKGROUND OF THE INVENTION

In the interior design field stuffed chairs are known, which comprise a seat for one or more people; a backrest; a fixed part; and at least one mobile part (e.g. a footrest, a headrest, and/or a massaging device), which is configured to move relative to the fixed part due to the action of an actuating device (e.g. an electric motor), which is supplied with power by an electrical circuit.

The electrical circuits used to supply power to the actuating device generally are of two types.

According to a first type, the electrical circuit comprises an electrical cable that is connected, on one side, to the actuating device and, on the other side, to the electrical grid and, therefore, to a wall power socket.

According to the other one of the two know types described above, the electrical circuit comprises a rechargeable battery, which is mounted inside the stuffed chair, and a plug, which is connected to the battery and extends through the stuffed chair so as to be accessible from the outside and allow a user to recharge the battery itself.

Known stuffed chairs of the type described above have some drawbacks, which are mainly due to the fact that, in one case, the electrical cable is relatively long and hard to move and, therefore, is constantly in the way during the normal use of the stuffed chair and, in the other case, the access to the battery is relatively difficult and its replacement necessarily requires the presence of skilled personnel and the restoration of the electrical connection among the new battery, the actuating device and the recharging plug.

SUMMARY OF THE INVENTION

The object of the present invention is to provide a stuffed chair with one or more seats, in particular an armchair or a couch, which is designed to eliminate the aforementioned drawbacks in a straightforward, relatively low-cost manner.

The present invention provides a stuffed chair with one or more seats, in particular an armchair or a couch, according to the appended claims.

BRIEF DESCRIPTION OF THE DRAWINGS

The present invention will now be described with reference to the accompanying drawings, which show a non-limiting embodiment thereof, wherein.

DETAILED DESCRIPTION OF THE INVENTION

Figure 1:
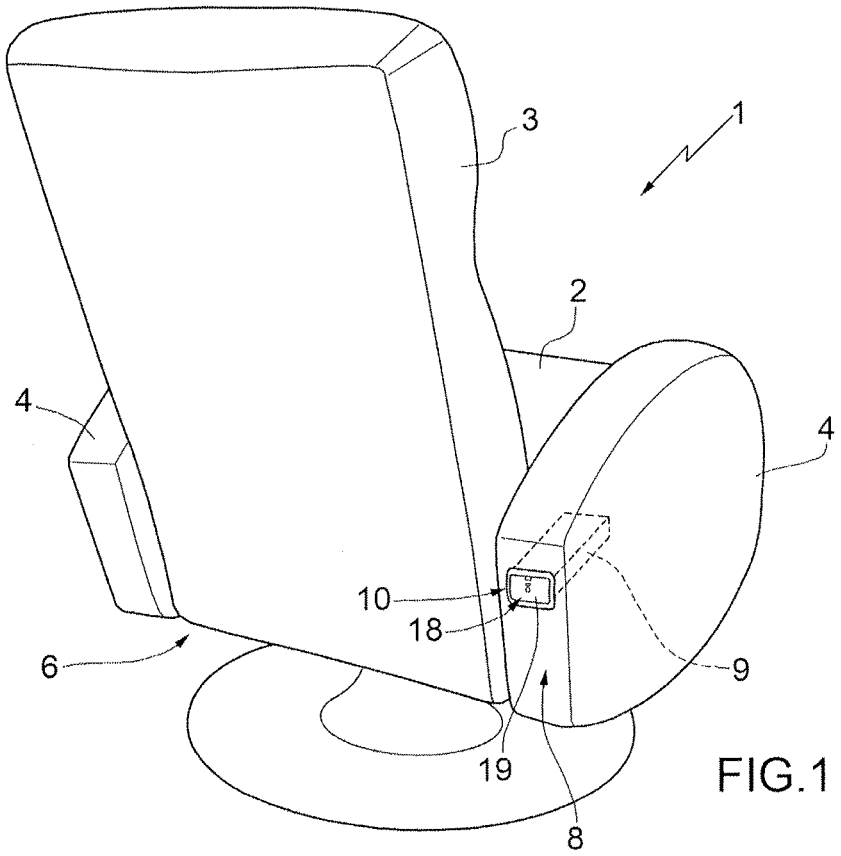
FIGS. 1 and 2 are two schematic perspective views of a preferred embodiment of the stuffed chair according to the present invention.
Figure 2:
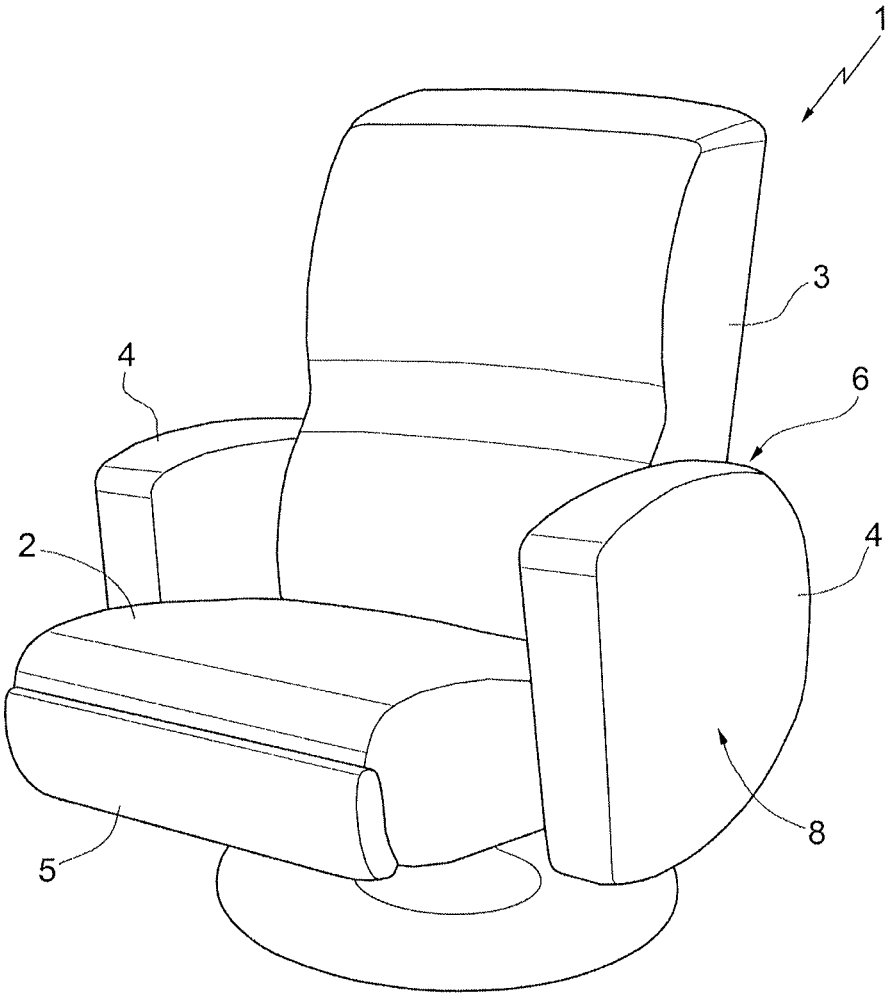

With reference to FIGS. 1 and 2, number 1 indicates, as a whole, a stuffed armchair having a seat 2, a backrest 3, and a pair of lateral armrests 4.

According to a variant that is not shown herein, the stuffed armchair 1 can be removed and replaced with a stuffed couch with multiple seats.

The stuffed armchair 1 comprises, especially, a front footrest 5, which is mobile relative to a fixed part 6 of the stuffed armchair 1 between a lowered rest position (FIG. 2) and a raised operating position (not shown).

Obviously, the stuffed armchair 1 can comprise further mobile parts, such as, for example, a headrest and/or a massaging device.

The footrest 5 is moved between its lowered rest position and its raised operating position by an actuating device 7, which comprises, in this special case, an electric motor, which is housed inside the stuffed armchair 1.

The stuffed armchair 1 is also delimited by an outer surface 8, and has a cavity 9, which, in this special case, is obtained in one of the armrests 4, has an oblong, substantially parallelepiped-like shape, and opens up outwards in correspondence to the surface 8 itself.

According to a variant that is not shown herein, the cavity 9 is obtained in other parts of the stuffed armchair 1.

Figure 4:
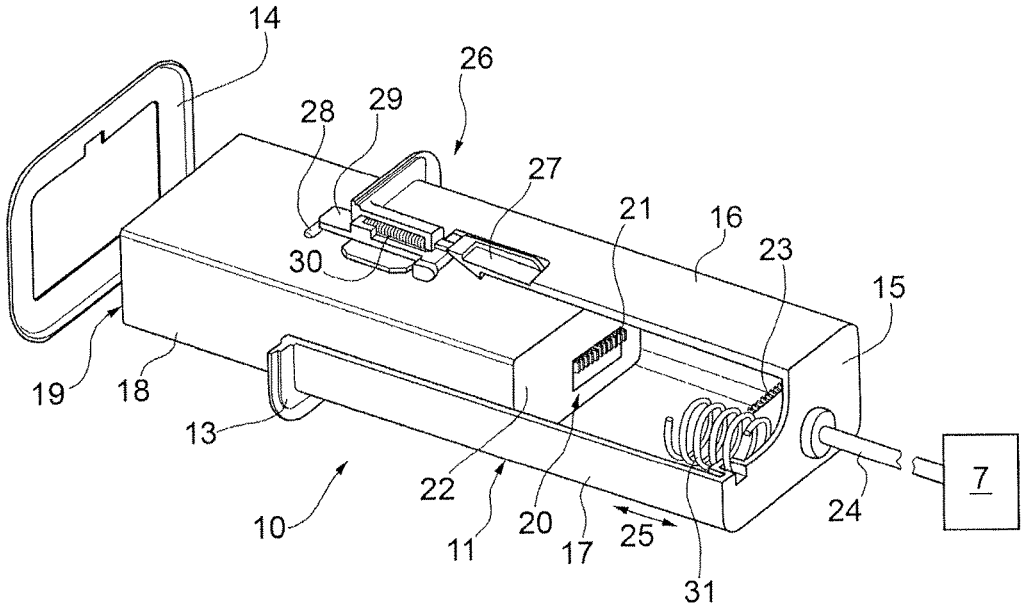
FIGS. 4 and 5 are two schematic perspective views of a second detail of the stuffed chair of FIGS. 1 and 2, which is shown in two different operating positions.
Figure 5:
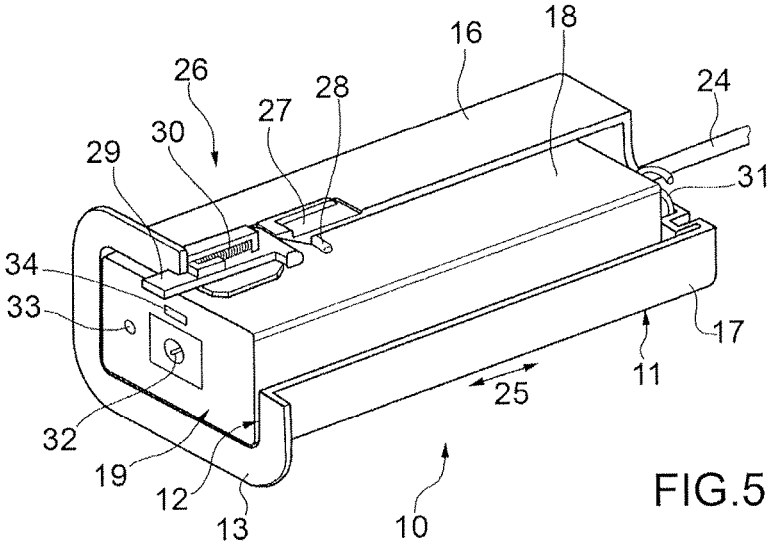

According to FIGS. 4 and 5, the device is supplied with power by a power supply 10 device comprising a containing box 11, which is cup-shaped, is housed inside the cavity 9 and, furthermore, has an inlet 12 that opens up outwards in correspondence to said outer surface 8.

The box 11 is provided, furthermore, with an annular flange 13, which extends around the inlet 12, allows the box 11 to be fixed to the stuffed armchair 1 by means of a pair of fixing screws (not shown) screwed into the surface 8, and is covered by a finishing frame 14.

The box 11 is delimited by a bottom wall 15 and, furthermore, is also delimited by two main lateral walls 16, which are substantially parallel to one another and perpendicular to the wall 15, and by two minor lateral walls 17, which are substantially parallel to one another and perpendicular to the wall 15 and the to the walls 16.

The device 10 comprises, furthermore, a rechargeable battery 18, which, in use, is mounted inside the box 11 through the inlet 12, substantially has the shape of the cavity 9 and of the box 11, and is delimited by an end face 19, which is visible on the outside of the stuffed armchair 1.

The actuating device 7 and the battery 18 are connectable to one another by means of a connection device 20 comprising a first plurality of electrical contacts 21 obtained on a bottom wall 22 of the battery 18 and a second plurality of electrical contacts 23, which are obtained on the wall 15 and are connected to the device 7 by means of the interposition of an electrical cable 24.

Figure 3:
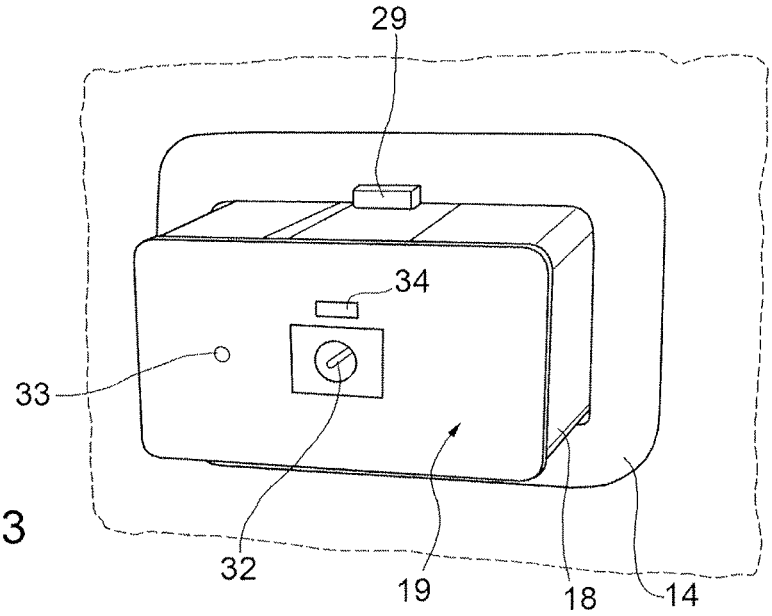
FIG. 3 is a schematic perspective view of a first detail of the stuffed chair of FIGS. 1 and 2.

The battery 18 is engaged in the box 11 in a sliding manner and is mobile, in a moving direction 25 that is substantially perpendicular to the walls 15 and 22, between an operating position (FIGS. 1 and 5), in which the battery 18 is substantially held inside the box 11, and an extracted position (FIGS. 3 and 4), in which the battery 18 projects outside of the box 11.

When the battery 18 is arranged in its operating position, the wall 22 is substantially arranged in contact with the wall 15 and the contacts 21 and 23 are connected to one another, whereas, when the battery 18 is arranged in its extracted position, the wall 22 is arranged at a given distance from the wall 15 and the contacts 21 and 23 are disconnected from one another.

The battery 18 is locked in its operating position on the inside of the box 11 by a coupling device 26 comprising an elastically deformable tooth 27, which is obtained through one of the main lateral walls 16 of the box 11.

The tooth 27 is normally arranged in a locking position, in which, when the battery 18 is inserted into the box 11, the tooth 27 hooks a rib 28 made on the battery 18 and locks the battery 18 in its operating position so as to ensure the connection between the contacts 21 and 23 and the power supply of the device 7.

The tooth 27 is moved from its locking position to a release position for releasing the battery 18 by a release push button 29, which extends in the direction 25 and projects outwards from the box 11 in correspondence to the inlet 12, so as to be operated by the user.

The push button 29 is mobile, relative to the box 11, in the direction 25 between an operating position, in which the push button 29 lifts the tooth 27 and disengages it from the rib 28, and a rest position.

The push button 29 is moved to—and normally kept in—its rest position by a spring 30, which is mounted between the box 11 and the push button 29 parallel to the direction 25.

When the tooth 27 is moved to its release position, the battery 18 is moved to its extracted position by a spring 31, which is hooked to the wall 15 and is interposed between the walls 15 and 22.

The face 19 of the battery 18 is provided with a power supply connector 32 to charge the battery 18, with a first light indicator 33 to display the charge state of the battery 18, and with a second light indicator 34 to display the charge mode of the battery 18 itself.

The power supply device 10 leads to some advantages that are mainly due to the fact that:

the box 11 opens up outwards in correspondence to the outer surface 8 of the stuffed armchair 1 and, therefore, allows the user to easily replace the battery 18 after having uncoupled it from the box 11 itself; and the position of the face 19 of the battery 18 allows the user to easily see the charge state and the charge mode of the battery 18.

According to a variant that is not shown herein, the connection device 20, the bottom wall 15 of the box 11 and the electrical cable 24 can be removed and replaced with a first electrical cable, which is connected to the actuating device 7, and with a second electrical cable, which is connected to the battery 18 and is connectable to the first electrical cable. The extraction of the battery 18 from the box 11 allows users to disconnect the two electrical cables, replace the battery 18 with a new battery 18 and reconnect the two electrical cables to one another.

Although the present invention has been described with reference to exemplary implementations thereof, the present invention is not limited by or to such exemplary implementations.

The invention claimed is:

1. A stuffed chair with one or more seats, comprising a seat;

a backrest;

at least one mobile part, which is configured to move relative to a fixed part;

an actuating device to actuate the mobile part; and an electrical circuit to supply power to the actuating device;

wherein the seat defines a cavity, which opens up outwards in correspondence to an outer surface of the seat;

a containing box, which is housed completely inside the cavity and is provided with an inlet that opens up outwards in correspondence to said outer surface;

a rechargeable battery, which is mounted inside the box through the inlet and is moveable between an operating position, in which the battery is and is connected to the electrical circuit, and an extended position, in which the battery projects outside the box and can be disconnected from the electrical circuit;

a coupling device which is moveable between a locking position, in which the battery is locked in its operating position, and a release position; and a thrust spring which is interposed between the box and the battery so as to move the battery to the extended position, when the coupling device is arranged in the release position;

wherein, in the operating position, the battery is completely housed inside the box.

2. A stuffed chair according to claim 1, wherein the coupling device comprises an elastically deformable tooth, which is obtained in the box and is normally arranged in said locking position.

3. A stuffed chair according to claim 2, wherein the coupling device further comprises a release push button, which projects outwards from the box in correspondence to the inlet and is mobile, relative to the box, between an operating position, in which the release push button engages the tooth in order to move it to said release position, and a rest position.

4. A stuffed chair according to claim 3, wherein the coupling device further comprises a further thrust spring, which is interposed between the box and the release push button so as to move the release push button to the rest position.

5. A stuffed chair according to claim 1, further comprising a connection device, which is obtained partly on the battery and partly on the box, so as to connect the battery and the electrical circuit to one another, when the battery is arranged in its operating position.

6. A stuffed chair according to claim 5, wherein the box is cup-shaped and is delimited by a bottom wall; the connection device comprising a first plurality of electrical contacts obtained on the battery and a second plurality of electrical contacts obtained on the bottom wall and connected to the electrical circuit.

7. A stuffed chair according to claim 1, wherein the battery and the electrical circuit comprise respective electrical cables that are connectable to one another.

8. A stuffed chair according to claim 1, wherein the battery is delimited by an end face that can be accessed from the outside in correspondence to said inlet.

9. A stuffed chair according to claim 8, wherein the end face has a power supply connector to charge the battery and at least one light indicator to display the charge state of the battery itself.

10. A stuffed chair according to claim 1, wherein the stuffed chair is selected from the group consisting of an armchair and a couch.

11. A stuffed chair according to claim 4, wherein the further thrust spring is effective to maintain the release push button in the rest position.

* * * * *